United States Patent [19]

Kitaguchi

[11] Patent Number: 5,007,385

[45] Date of Patent: Apr. 16, 1991

[54] CRANKLESS ENGINE

[76] Inventor: Hiromasa Kitaguchi, Chi-101, Simamachi, Komatsu-shi, Isikawa-ken, 923-03, Japan

[21] Appl. No.: 501,712

[22] Filed: Mar. 30, 1990

[30] Foreign Application Priority Data

Jul. 15, 1989 [JP] Japan ..... 1-183410
Feb. 6, 1990 [JP] Japan ..... 2-26958

[51] Int. Cl.[5] ..... F02B 75/04

[52] U.S. Cl. ..... 123/48 B; 123/58 BA; 123/78 E

[58] Field of Search ..... 123/48 R, 48 B, 78 R, 123/78 E, 78 BA, 58 BA, 58 BB, 78 F

[56] References Cited

U.S. PATENT DOCUMENTS

| | | | |
|---|---|---|---|
| 821,546 | 5/1906 | Smallbone | 123/58 BA |
| 1,255,973 | 2/1918 | Almen | 123/58 BA |
| 1,968,470 | 7/1934 | Szombathy | 123/48 B |
| 2,042,730 | 6/1936 | Redrup | 123/58 BA |
| 2,263,561 | 11/1941 | Biermann | 123/48 B |
| 2,910,973 | 11/1959 | Witzky | 123/48 B |
| 3,176,667 | 4/1965 | Hammer | 123/48 R |
| 4,066,049 | 1/1978 | Teodorescu et al. | 123/48 B |
| 4,112,826 | 9/1978 | Cataldo | 123/48 B |
| 4,168,632 | 9/1979 | Fokker | 123/48 R |
| 4,174,684 | 11/1979 | Roseby et al. | 123/48 B |

FOREIGN PATENT DOCUMENTS

| | | | |
|---|---|---|---|
| 18581 | 4/1956 | Fed. Rep. of Germany | 123/58 BA |
| 1451926 | 3/1970 | Fed. Rep. of Germany | 123/48 R |
| 2931377 | 2/1981 | Fed. Rep. of Germany | 123/58 BA |
| 160591 | 7/1954 | Netherlands | 123/58 BA |

*Primary Examiner*—David A. Okonsky
*Attorney, Agent, or Firm*—Oblon, Spivak, McClelland, Maier & Neustadt

[57] ABSTRACT

The present invention relates to a mechanism for transforming a reciprocating motion and a rotating motion from one to the other, and more particularly to a crankless engine in which in place of a crank shaft there is used a rocking member having a rockable fulcrum and adapted to perform rocking motions without rotating on its own axis, like a spherical bearing or a cross-type universal bearing. The above motional transformation is effected in high mechanical efficiency by pivotal connection between the said rocking member and a rotary shaft. The compression ratio can be changed, and the engine is durable.

21 Claims, 10 Drawing Sheets

CRANKLESS ENGINE

BACKGROUND ART

The present invention relates to a reciprocating type internal combustion engine for use as a driving unit in automobiles, motorcycles, construction machines, agricultural machines, light airplanes, ships, generators, etc., as well as a compressor and a pressure reducing machine for pressurizing fluid or reducing the pressure thereof.

The conventional crank engines are used as internal combustion engines in various fields. On the other hand, barrel type crankless engines have been devised as engines which omit crank or as improvements over crank engines [see, for example, Toru Daidoji, "Crankless Engine," Nikkan Kogyo Shinbun-Sha (May 25, 1961), P. 239]. These crankless engines are of a structure having an inclined crank pin, which is also called a Z type crank shaft.

As engines of this type there have also been developed barrel cam type and swash plate type crankless engines. But both are disadvantageous in point of durability and production because the transfer portion includes linear or point contact or the sliding velocity is too high. Therefore, they have not become popular yet. As a crankless engine which has been put to practical use there is a rotary engine (manufactured by Matsuda Co.).

As compared with the reciprocating type engines, the rotary engine is superior in point of smoothness of rotation, reduced size and weight, reduced number of parts required, and simplified structure. However, the fuel economy is poor, which is ascribable to the leakage of gas from the apex or side seal, and in this is point the rotary engine involves a serious problem.

In the reciprocating type engines available at present there are used four to five intake and exhaust valves for each cylinder to improve performance and fuel economy. But this is almost a limit.

As to reciprocating type engines, the development of a high-powered engine capable of affording smooth rotation and superior in quietness has been desired. Also in the field of air compressors and vacuum pumps using a piston it has been desired to develop products of high efficiency.

Particularly, in reciprocating type multicylinder engines having a crankshaft, there have been drawbacks. For example, the manufacturing cost is high because of a complicated shape, and it is necessary to use a number of bisplit bearings which are peculiar to the crankshaft, resulting in increase in size of the entire engine.

Besides, the increase the number of bearings gives rise to the problem that the slip loss of bearings is large, the mechanical efficiency becomes poor, and the amount of fuel consumed is increased.

Further, the material cost, forging cost and machining cost for the crank shaft are increased, and considerable time is required for a complicated machining in the crank case bearing portion, so it is now necessary to cope with the increase of the manufacturing cost.

More particularly, multicylinder engines are required for the purpose of attaining increased output and smooth rotation, and like a demand contradictory thereto, the reduction of size and weight are required.

On the other hand, it is necessary to attain both the improvement of performance and the decrease in the amount of fuel consumed. To this end, manufacturers are earnest about studies and there has been a recent tendency to increase in the number of intake and exhaust valves. But it seems that this way of doing has already reached a limit.

Under such background, various crankless engines have been devised as mentioned above, but most of them have not been put to practical use.

The following are mentioned as reasons why crankless engines have not been used practically.

(1) In many of crankless engines there is a portion in which contact surfaces are in point or linear contact as in the combination of a barrel cam and a roller, so wear out sooner to an unpractical extent.

(2) Since the sliding velocity is high, a high-speed rotation is not obtained and so it is impossible to attain the improvement of performance.

(3) On the same displacement basis, the volume of the entire engine becomes too large, resulting in increase of weight.

(4) Many of the crankless engines in question are difficult to machine and cause problems in their manufacture.

(5) The structure is too complicated, resulting in increase of cost, which is a problem when viewed from the economic point of view.

OBJECTS OF THE INVENTION

It is the greatest object of the present invention to dispense with a crank shaft, use a rocking member instead, thereby reducing the number of bearings to diminish a lateral pressure of each piston and decrease wear, and further decrease the sliding velocity, thereby diminishing the slip loss of bearings and decreasing the amount of fuel consumed.

It is another object of the present invention to replace output and input shafts with each other to effect a motion transformation reverse to that in internal combustion engines, as in compressors and vacuum pumps, and like the above, attain the improvement of mechanical efficiency and of the driving force transmitting efficiency.

SUMMARY OF THE INVENTION

A rocking member and a rotary shaft both used in the present invention correspond to the conventional crankshaft. A pin of the rocking member adapted to perform rocking motions with a spherical bearing or a cross-type universal bearing as a fulcrum is fitted in the rotary shaft and rotates with the rotary shaft as an output shaft. Conversely, the rotary shaft is used as an input shaft to let a piston to act to compress fluid or reduce the pressure of air.

In a conventional reciprocating type engine, the larger the number of cylinders, the more complicated the structure of the crank shaft and the larger the number of bearings To avoid this, in the represent invention, a crank shaft is not used and instead there is adopted a structure in which a rotating force is given to the rotary shaft by means of the rocking member, and a joint having a spherical bearing or pin joint structure is mounted to the rocking member so that a plurality of pistons can be connected to the rocking member. With this structure, even an engine having a number of pistons can be simplified in structure.

Besides, the rocking member does not rotate on its own axis, but transfers power through rocking motions alone, so that the sliding velocity is low and the transfer efficiency is improved. Moreover, since the conventional crank shaft is replaced with the rocking member which is small-sized, the engine becomes light-weight. Also, the fuel economy is improved because of exclusion of the crank shaft which requires the provision of a number of bearings and causes deterioration of mechanical efficiency.

Further, in conventional multicylinder engines, the crankshaft is long, giving rise to torsional vibrations, so it is necessary to take a measure for preventing such vibrations, for example the use of a damper. Even in the case of a multicylinder engine, the use of the rocking member in the present invention is advantageous against such vibrations because it is short.

On the other hand, for the purpose of increasing output and decreasing the amount of fuel consumed, it has been desired to use a mechanism for changing the compression ratio in the combustion chamber. In crank engines, however, such mechanism has not been put to practical use because of more complicated structure, while in the crankless engine of the present invention, the changing of the compression ratio can be done by simple means.

Further, since the crankless engine of the present invention is simple in structure even in a multicylinder mode, it can be fabricated easily as a compressor or a vacuum pump in addition to the engine, whereby the decrease of the manufacturing cost can be attained.

A combustion chamber is formed on one or both sides of each piston. Expansion energy created in the combustion chamber pushes the piston and is transferred to part of the rocking member through the joint connected to the rocking member. With this force, the rocking member rocks with the universal bearing which supports the rocking member as a fulcrum, so that the said part of the rocking member imparts rotation to the rotary shaft, thus generating a driving force of the engine.

Or, conversely, using the rotary shaft as an input shaft, a rotating force is given by the power of motor or engine, causing each piston to reciprocate, whereby gas or air can be compressed or reduced in pressure.

BRIEF DESCRIPTION OF THE DRAWINGS

FIGS. 1 to 11 illustrate embodiments of the present invention, in which:

FIG. 1 is an entire sectional view of an embodiment of the present invention;

FIG. 2 is a sectional view showing an example of means for interconnecting each piston and a rocking member;

FIG. 4 is a sectional view showing another example of the present invention adopting a cross-type universal bearing;

FIG. 5 is a sectional view of a one-side combustion chamber type multicylinder engine according to another embodiment of the present invention;

FIG. 6 is a sectional view showing another structural example of a rocking member and a spherical bearing;

FIG. 7 is a view showing an example of a mechanism for stabilizing rocking motions of the rocking member;

FIG. 8 is a view showing another example of the mechanism of FIG. 7;

FIG. 9 is a view showing a modification of FIG. 8;

FIG. 10 is a sectional view of an embodiment of the invention further including a compression ratio changing mechanism; and FIG. 11 is a view explanatory of the operation of FIG. 10.

DETAILED DESCRIPTION OF THE INVENTION

The present invention will be described hereinunder with reference to the drawings.

Figure 1:
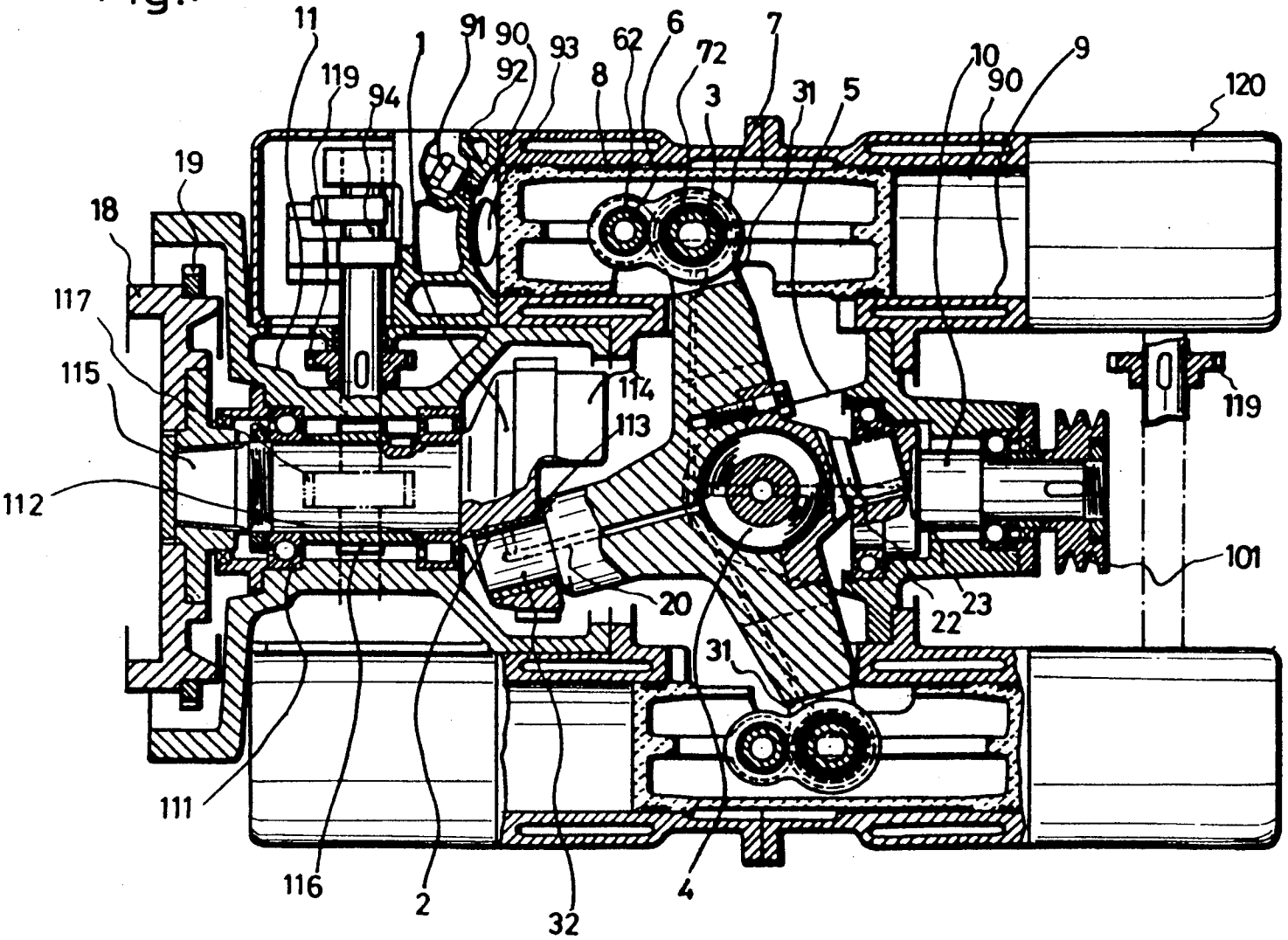

In FIG. 1, a rotary shaft 1 (hereinafter referred to as the "output shaft 1") is supported in a case 11 rotatably through bearings 111 and 112.

One end of the output shaft 1 is projected inside the case 11, and an inclined hole 113 is formed in the said one end, with a bearing 2 being inserted into the hole 113.

In a position opposed to the hole 113 of the output shaft 1 there is formed a balancer 114 for balancing a centrifugal force which is created by an eccentric motion of a rocking member 3.

On the other hand, the output shaft 1 projects outside the case 11 to form a projecting portion 115, which serves as an output take-out portion, with a spline or serration or key way being formed in the outer peripheral portion of the shaft.

In a position near the middle of the output shaft there is formed a screw gear 116 for driving a cam shaft. The screw gear 116 can also be used for driving an auxiliary engine.

The rocking member 3 is fitted in the spherical bearing 4 in an eccentrically rockable state. The spherical bearing 4 is mounted to a bracket 5, and the front end of a pin portion 32 on the side of the output shaft 1 is inserted in the interior of the bearing 2 and pivotally secured for rotation.

A spherical bearing 72 is provided in an outer-pheriphery connection 31 of the rocking member 3, and one end of a joint 7 is attached thereto. The other end of the joint 7 is connected by fitting of a piston 6 and a spherical bearing 62.

Further, a piston 8, which is connected through the joint 7, is disposed slidably within a cylinder 9, and a cylinder head 92, which is mounted to cover the cylinder 9, is provided with a spark plug 91 and an intake-exhaust valve 93. The piston 8 is fitted in the cylinder 9 for reciprocating motion.

Figure 5:
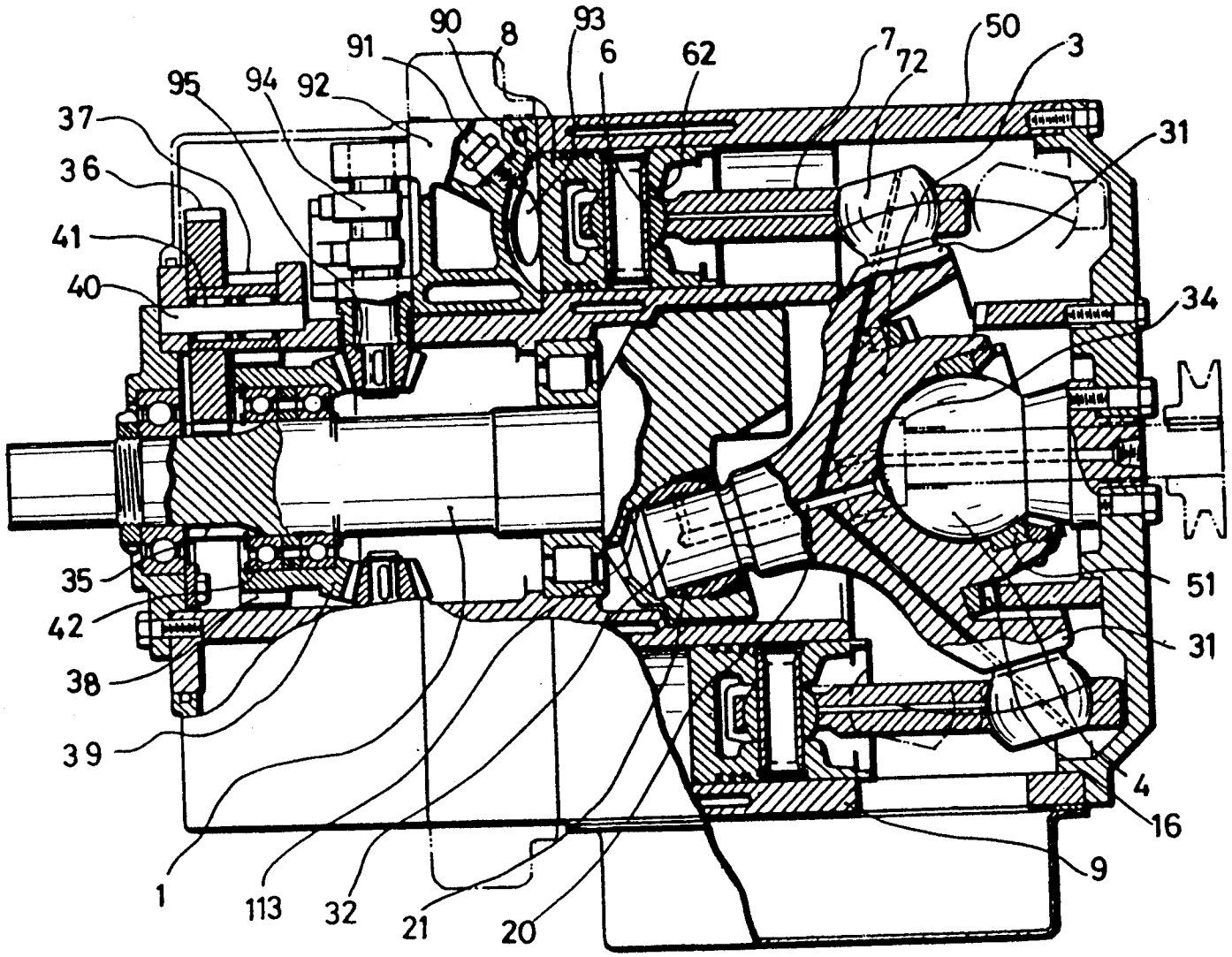

As to the piston 8, there are two types, one of which combustion chambers 90 on both sides of the piston 8, as shown in FIG. 1, and the other has a combustion chamber on only one side, as shown in FIG. 5. The both-side type has cylinders twice as large in number as the one-side type.

An output shaft 10 for auxiliary machinery 10 shown in FIG. 1 has a structure capable of taking out a rotating force through a system separate from the output shaft 1 by utilizing the eccentric rocking motion of the rocking member 3.

A pin 22, which is mounted to the rocking member 3, serves to drive the auxiliary machinery output shaft 10. A pin receptacles 22 is a bearing which transfers power to the output shaft 10 for auxiliary machinery while rotating under sliding together with the pin 22.

The output shaft 10 for auxiliary machinery is used for driving cooling fans, generators, pumps, compressors for cooling, etc. A pulley 101 is mounted on the front end of the output shaft 10 for auxiliary machinery.

An oil hole 20 is for feeding lubricating oil to various sliding surfaces.

The crankless engine illustrated in FIG. 1 is a four-cycle gasoline engine, which operates as follows.

The gas compressed by the piston 8 is ignited by the spark plug 91, thereby burns and expands, and the resulting pressure presses the piston 8 toward the opposed combustion chamber 90. This pressing force is transmitted through the joint 7 to the outer-periphery connection 31 of the rocking member 3 and pushes it. Since the pin portion 32 of the rocking member 3, which is supported by the spherical bearing 4 as a fulcrum, is restrained so as to be movable only in the rotating direction of the output shaft 1, the pushing force of the piston 8 serves as a motion to rotate the output shaft 1 with the fitted portion of the rocking member 3 in the spherical bearing 4 as a fulcrum.

The above combustion stroke is carried out also in the other combustion chambers 90. In each combustion chamber 90, combustion, exhaust, intake and compression strokes are performed in this order as one cycle. That is, the piston 8 which experienced a combustion pressure and thereby pushed in one combustion chamber 90 acts to carry to a gas compressing or exhaust stroke in another combustion chamber 90.

A screw gear 117 on a driven side is perpendicularly in mesh with the screw gear 116 formed on the output shaft 1 and it is connected to a cam shaft 94. The cam shaft 94 functions to actuate the intake-exhaust valve 93 directly or through a rocker arm.

A timing gear 118 is fixed to the cam shaft 94 and it is connected to a timing gear 119 through a chain or a timing belt. The timing gear 118 actuates a valve mechanism provided on an opposed, cylinder head 120 side.

The teeth ratio of the screw gears 116 and 117 is set at 1:2 because in a four-cycle engine it is necessary that the number of revolutions of the cam shaft 94 be set at one half relative to the output shaft 1. In a two-cycle engine having an intake-exhaust valve, the screw gear 116, 117 teeth ratio may be 1:1.

A water jacket 17 is provided for cooling each cylinder using water.

The numeral 19 denotes a flywheel. A ring gear 19, which is fixed to the flywheel 18 for starting the engine, is adapted to come into mesh with a pinion of a starter motor.

Figure 2:
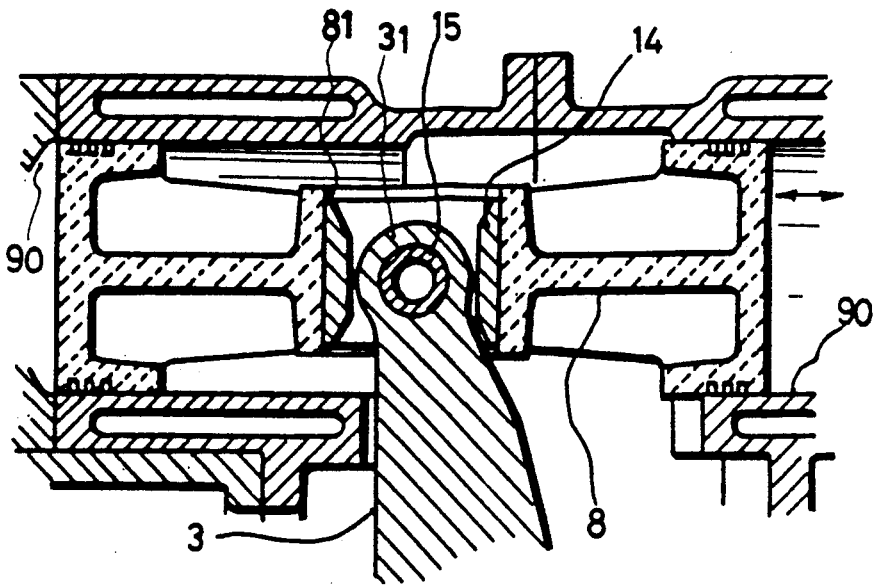

Referring now to FIG. 2, there is shown another example of connection between the piston 8 and the rocking member 3. A slide hole 81 is formed in the piston 8, and a cylindrical slider 14 capable of sliding perpendicularly to the moving directions of the piston 8 is used in place of the spherical bearing 72. This is suitable for the cylinder arrangements of FIGS. 3(A) and 3(B), and is also employable in the cases of FIGS. 3(C) and (D). In this case, the outer-periphery connection 31 is the rocking member 3 should be made movable in the axial direction of a pin 15.

Figure 3A:
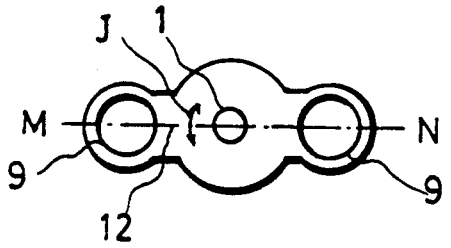
FIGS. 3(A) to 3(D) are schematic diagrams showing examples of cylinder arrangements.
Figure 3C:
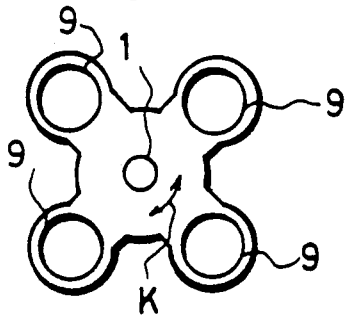
Figure 3B:
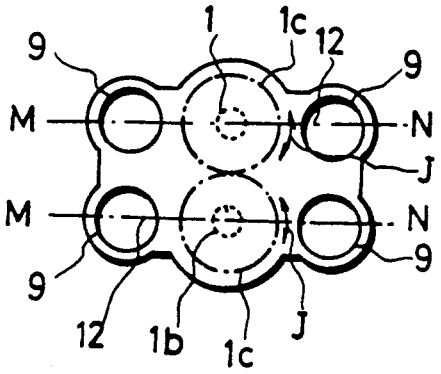

The structure of FIG. 3(B) is suitable for high-class automobiles having an engine as fat as possible and provided with many cylinders, for example, having a limited engine room. According to this structure, two such engines as shown in FIG. 3(A) are put one upon the other, and gears 1*c*, 1*c* mounted on output shafts 1, 1*b* are in mesh with each other so as to be 90° out of phase in their engine rotating phases. This structure is of a four- or eight-cylinder engine, which can be accommodated compactly in the engine room.

Figure 4:
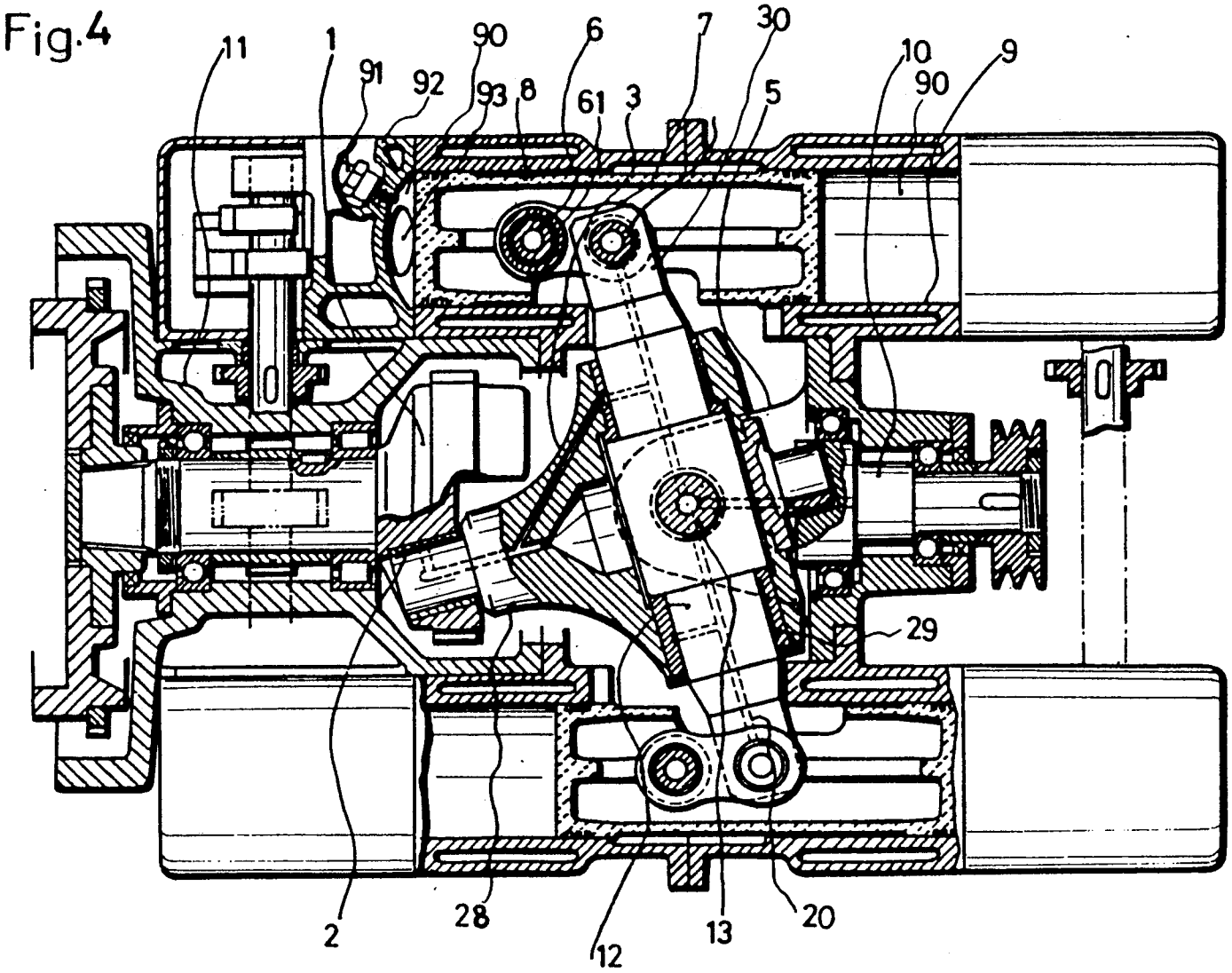
Figure 6:
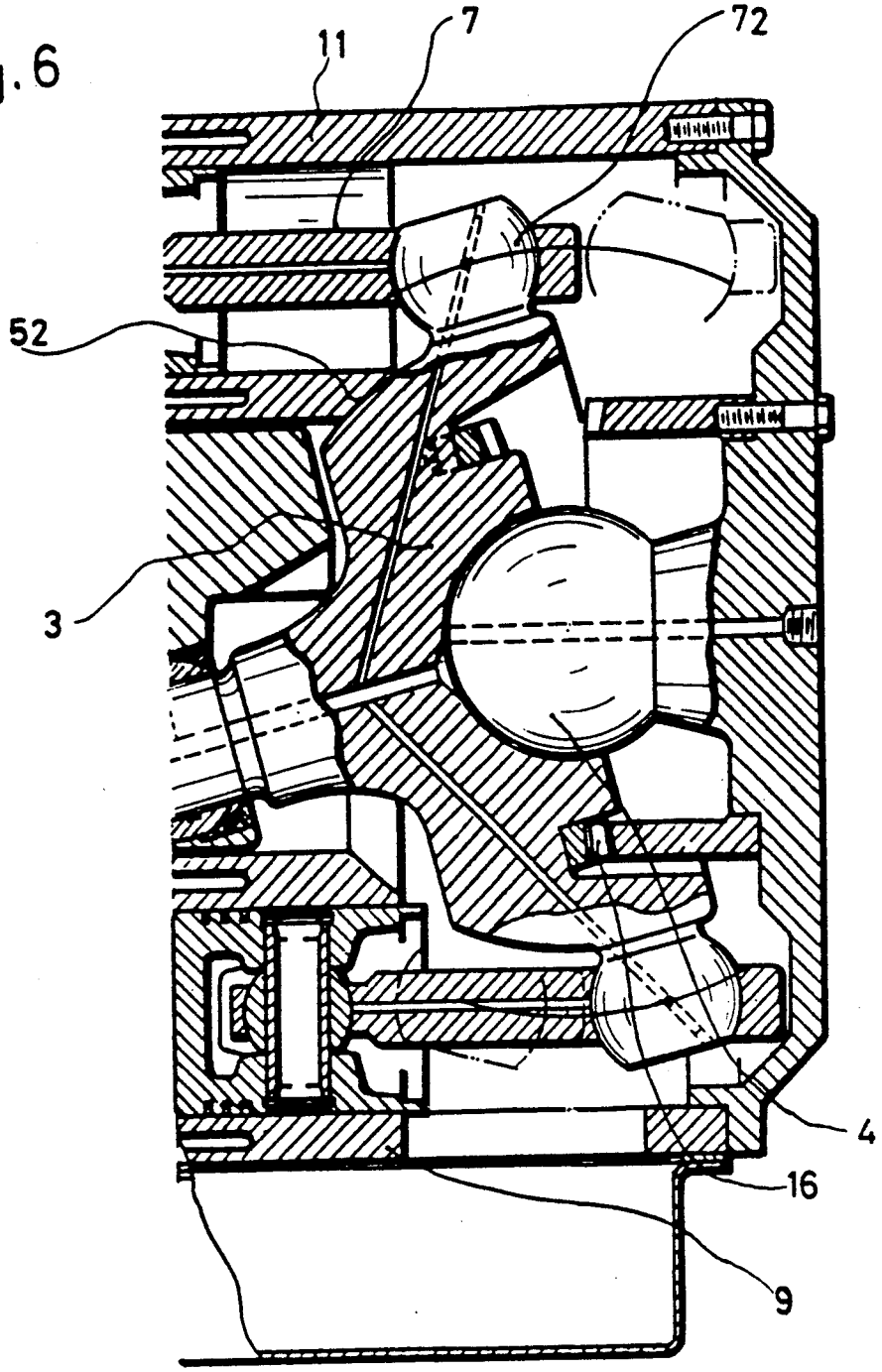

FIG. 4 is a sectional view showing another structure in which there is adopted a cross-type universal bearing as the fulcrum of the rocking motion of the rocking member 3 in place of such a spherical bearing 4 as shown in FIGS. 1, 5 and 6. The cross-type universal bearing comprises a main cross shaft 12 and a sub cross shaft 13 which is supported by the bracket 5.

Into the rocking member 28 there is inserted a bearing 29, in which is fitted the main cross shaft 12, so that the rocking member 28 can rock about the main cross shaft 12. Therefore, using the intersecting point between the main and sub cross shafts 12, 13 as a fulcrum, the rocking member 28 performs the same eccentric rocking motion as in the spherical bearing 4 shown in FIGS. 1, 5 and 6.

In this case, the piston 8 is connected to the joint through the pin 6 and a bushing 61. The main cross shaft 12 and the joint 7 are interconnected through a pin bearing 71.

FIG. 5 is a sectional view of a barrel type multicylinder engine according to another embodiment of the present invention, which the combustion change 90 is disposed on only one side of the piston 8. A suitable number of cylinder is seven to nine, but a larger number is also adoptable.

If a spherical bearing 21 is used as the outer bearing surface of the pin portion 32 which is inserted to the hole 113 of the output shaft 1, it is possible to absorb a distortion induced when a force is exerted on the rocking member 3 and also absorb an error in machining accuracy, so that the contact of the inner surface of the spherical bearing 21 with the associated shaft is effected in a better condition, thus leading to improved durability.

In order that the rocking member 3 shown in FIG. 5 can perform a stable rocking motion, a bevel gear is used as a stabilizing gear 16.

Figure 7:
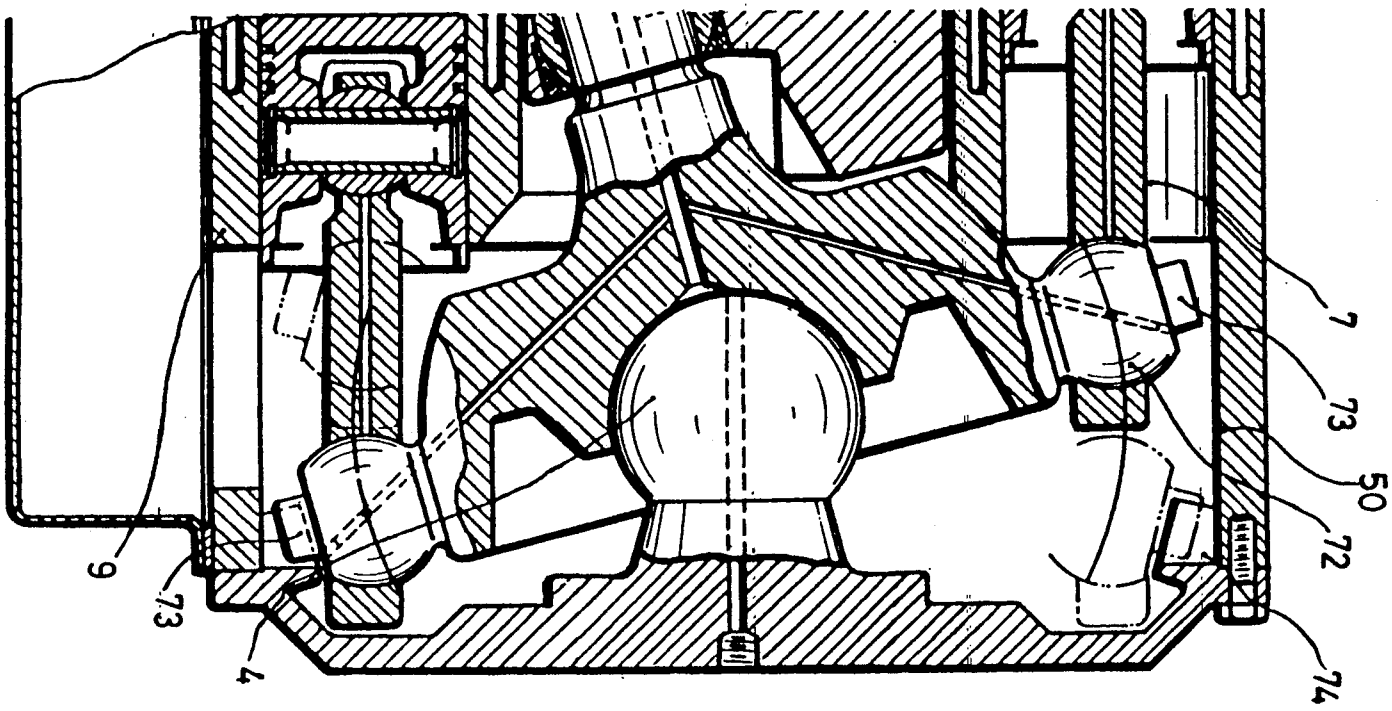

According to another method for stabilizing the rocking motion of the rocking member 3 without using a bevel gear, as shown in FIG. 7, a cylindrical protrusion is formed on the head of each spherical bearing 72 so as to be provided with cylindrical teeth 73, which serves as the teeth of a gear and corresponds to a gear of nine teeth in the case of a nine-cylinder engine, while a ring-like crown gear 74 is mounted to a cylinder skirt portion 50 so that it is in mesh with the cylindrical gear 73. By this construction, the rocking motion of the rocking member 3 can be stabilized.

Figure 8:
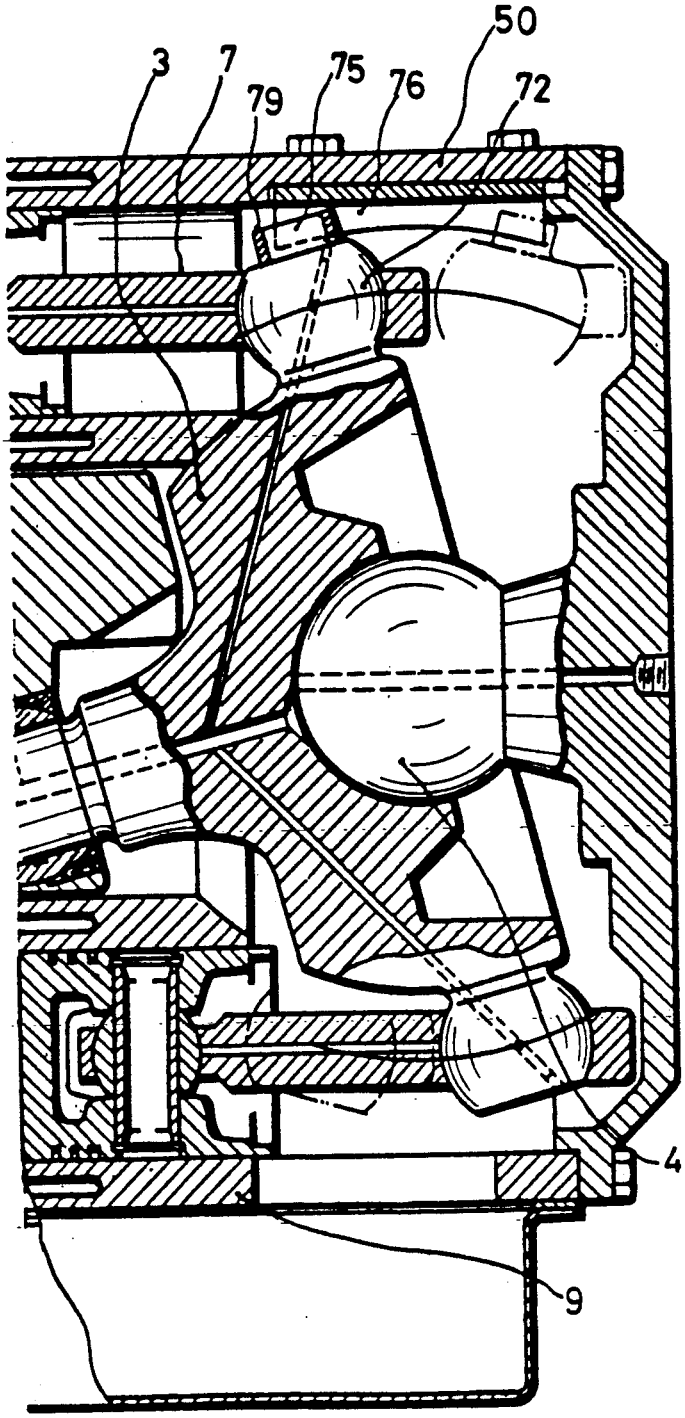

According to a further method for stabilizing the rocking motion of the rocking member 3, a slide pin 75 like the above cylindrical protrusion is provided in a certain position of the spherical bearing 72 shown in FIG. 8, and a guide 76 capable of moving only in the moving directions of the piston 8 is mounted to the cylinder skirt portion 50. The slide pin 75 is moved along the guide 76, whereby the rocking motion can be stabilized. In this case, if a slider 79 having a flat face for abutment with the guide 76 is fitted in the slide pin 75, the durability is improved.

Figure 9:
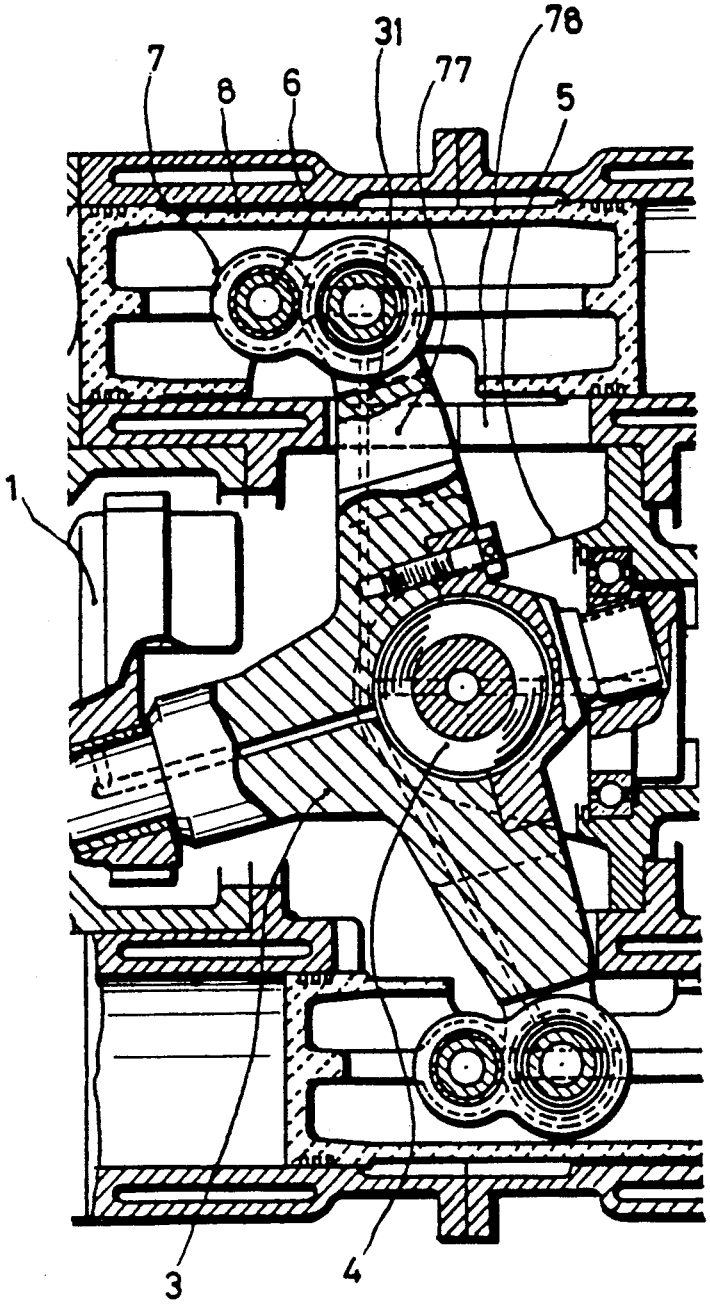

In FIG. 9, a similar guide 78 to the guide 76 shown in FIG. 8 is provided and a sliding surface 77 having a cylindrical surface is slid along the guide 78 to attain a stable rocking motion.

The piston 8 shown in FIG. 5 is almost the same as in the conventional engines, provided that the spherical bearings 62 and 72 are used in the piston 8—joint 7 connection and the rocking member 3—joint 7 connection.

In FIG. 5, a pinion 35 is attached to the output shaft 1 directly. A gear 36 is in mesh with the pinion 35, and a second pinion 37, which is integral with the gear 36, is in mesh with a second gear 38.

A bevel pinion 95 is fixed to the cam shaft 94 and it is in mesh with a bevel gear 39 which is integral with the second gear 38.

In a four-cycle engine for example, it is necessary to set the number of revolutions of the cam shaft 94 at one half relative to the output shaft 1, so if the teeth ratio of the second pinion 37 and the second gear 38 is made identical with that of the bevel gear 39 and the bevel pinion 95, the number of revolutions of the cam shaft 94 can be decreased to one half by setting the pinion 35—gear 36 teeth ration at 1:2. In this case, since the rotation of the bevel gear 39 and that of the bevel pinion 95 are accelerated the second pinion 37 and the second gear 38 are of a combination in which their rotations are decelerated.

The output shaft 34 for auxiliary machinery takes out rotation from a circular motion induced by the eccentric rocking motion of the rocking member 3.

Since the engine shown in FIG. 5 is of a one-side cylinder head type, the mounting of intake and exhaust pipes is better coordinated and so it is possible to reduce the size as a whole. Thus, this engine is suitable for automobiles having a small engine room.

FIG. 6 shows an example of a simplified structure of the rocking member 3 and that of the spherical bearing 4. According to this structure, a spherical holder 51 shown in FIG. 5 is not used in order to facilitate assembly and maintenance, while the cylinder 11 and the rocking member 3 are each provided with a spherical sliding surface 52 shown in FIG. 6 for preventing disengagement of the rocking member 3 from the spherical bearing 4.

In this case, while the engine is in operation, an expansion pressure induced by combustion acts to push the rocking member 3 toward the spherical bearing 4, with little force exerted in the direction of the spherical sliding surface 52, so there is no fear of slip loss or wear.

In connection with the spherical bearing 4 shown in FIGS. 1, 5 and 6, it is important that this bearing portion should be resistant to seizure and be made of a material which is immune to wear and is durable.

For example, fine ceramics whose advancement is outstanding may be used to make the most of its characteristics that is material is less wettable, difficult to cause seizure, and its resistance to wear is high. These characteristics, in combination with the supply of an appropriate oil a pressure, permits the fabrication of a bearing which is stable and has a long life.

It is also important that the material used for this bearing be small in its coefficient of friction. In the case of fine ceramics of silicon carbide, there is available one whose coefficient of friction is about 0.04 according to data [see "Nikkei Mechanical," Nikkei BP Co. (Sept. 18, 1989)].

However, there is the problem of fragility which is said to be a drawback of fine ceramics, and if as a solution to this problem there is adopted a method in which a special steel having toughness is used as a matrix material and small, polygonal fine ceramic pieces having a thickness of several millimeters are stuck side by side on the surface of the special steel matrix, not only the external form accuracy is improved and the finishing time can be shortened, but also there can be obtained a bearing having high resistance to wear and high accuracy in which the resulting gaps serve as passages for oil.

As other materials there may be used super hard alloy and special alloy steel after carburizing and hardening. But it is important to select a suitable mating material.

Figure 3D:
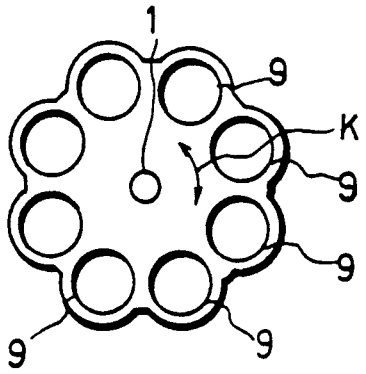

For connection of the joint 7 there are two methods, which will be explained below.

Where there are three or more cylinder positions as in FIGS. 3(C) and 3(D), the outer-periphery connection 31 of the rocking member 3 shown in FIGS. 1, 5 and 6 rocks not only in the moving directions of the piston but also slightly in the directions of arrow k shown in FIGS. 3(C) and (D), so it is impossible to adopt a connecting method using a pin which permits only connection of two-dimensional motions. In this case, therefore, there is adopted such a spherical shape as the spherical bearing 72.

In the example shown in FIG. 4 there is adopted a cross-type universal bearing. In this case, the cylinder arrangements of FIGS. 3(A) and 3(B) are applicable, and an end 30 of the main cross shaft shown in FIG. 4 rocks only in the moving directions of the piston 8 using the sub cross shaft 13 as a fulcrum, and this motion is a two-dimensional motion not involving movements in the directions of arrow j shown in FIGS. 3(A), (B), so in this case it is possible to adopt a pin like the pin bearing 71.

Thus, where the cylinder arrangement is like FIGS. 3(A) or (B), there is allowed only two-dimension motions on a plane on its section M-N, namely only in the moving directions of the piston 8, so a pin connection can be adopted in the joint 7 mounting portion of the rocking member 3, while in such multicylinder arrangements as FIGS. 3(C) and 3(D), it is necessary to adopt a spherical bearing for the connection of the joint 7.

The cylinder arrangements shown in FIGS. 3(A) to 3(D) are of only even numbers and this will do in the case of a two-cycle engine. But in the case of a four-cycle engine, it is better to use a cylinder arrangement of an odd number because the flow of the ignition order of gas is improved.

As to the piston 8, combustion chamber 90, spark plug 91, intake-exhaust valve 93 and cam shaft 94, the conventional technique can be applied as it is, so there is no such deterioration of fuel economy caused by the leakage of gas as in the case of a rotary engine. Therefore, the present invention is also applicable to diesel engines and two-cycle engines in addition to four-cycle gasoline engines.

A further embodiment of the present invention will be described below with reference to FIGS. 10 and 11.

According to the construction illustrated in those figures, a mechanism capable of changing the compression ratio is attached to the engine of the present invention to increase the compression ratio, thereby improving the thermal efficiency, enhancing the output and decreasing the amount of fuel consumed. On the other hand, at a high compression ratio, when a high load is applied while the engine is rotating at low speed, there may occur knocking due to abnormal combustion, which leads to a lowered output or damage of the engine, so in order to prevent these inconveniences, it is possible to make a change from the high compression ration to a lower compression ratio. Thus, it is intended to attain high performance and the decrease of the amount of fuel consumed by making the most of the advantages of both high and low compression ratios.

Recently there have been proposed various methods for changing the compression ratio; for example, a method in which an eccentric bushing is incorporated in a large or small end portion of a connecting rod and it is turned to change the length of the connecting rod to thereby adjust the compression ratio, and a method in which a hydraulic cylinder is provided in the interior of a piston and the compression ratio is changed by a change in height of the piston which is caused by a change in the strength of a combustion pressure against the oil pressure in that cylinder. In all of those methods, however, it is necessary to provide such mechanism for each piston, so in the case of a multicylinder type engine, the mechanism is fairly complicated, or the weight of the piston increases, thus making it impossible to obtain a desired high-speed rotation.

In the present invention, the mechanism in question may be provided in only one place even in the case of a multicylinder engine, and the structure required is a simple structure in which the position of the rocking member 3 is merely controlled. Therefore, it can be said that this structure is most suitable for an engine provided with such compression ratio changing mechanism.

Figure 10:
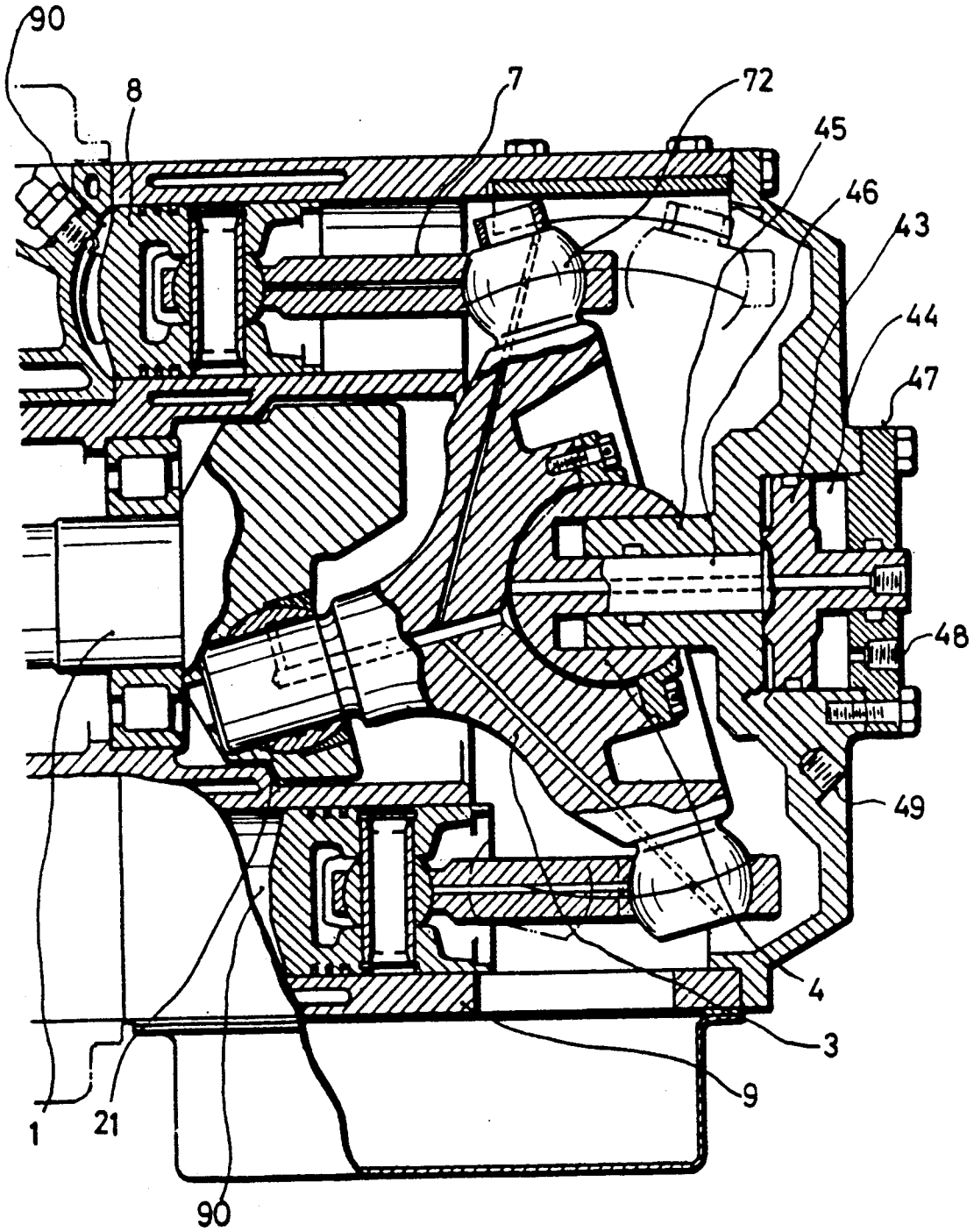

FIG. 10 is a sectional view of a portion of a gasoline engine of a one-side combustion chamber type, in which the spherical bearing 4 is fitted on a cylindrical shaft 45 so as to be slidable in parallel with the piston operating direction.

The spherical bearing 4 is provided with a rod 46 integrally, the rod 46 extending slidably through the center of the shaft 45, and a slidable hydraulic piston and the rod 46 are connected to the interior of a hydraulic cylinder 44. The hydraulic cylinder 44 is closed with a cover 47, while hydraulic oil ports 48 and 49 are kept in communication with each other. And a pin portion of rocking member 3 is slidably connected into the spherical bearing 21.

The position shown in FIG. 10 corresponds to a high compression ratio, in which an oil pressure is applied through the hydraulic oil port 48. (In this case, the pressure to the hydraulic oil port 49 is set at a value close to zero.) And the spherical bearing 4 has moved to the position in which the compression ratio of the piston is the highest.

Figure 11:
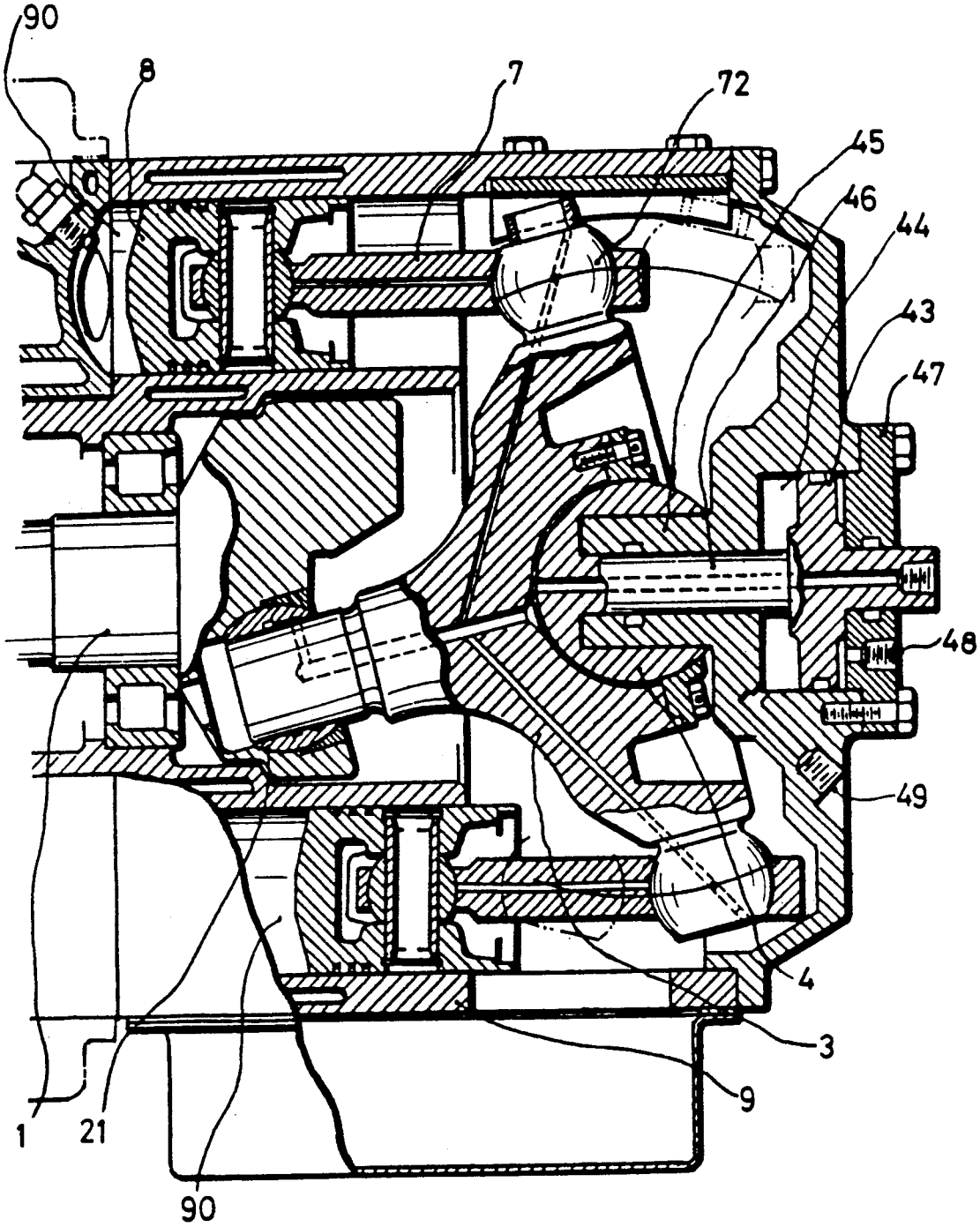

On the other hand, the position shown in FIG. 11 corresponds to the lowest compression ratio. By releasing pressure from the hydraulic oil port 48 and applying an oil pressure to the hydraulic oil port 49, the piston 43 is moved to the illustrated position together with the spherical bearing 4. Consequently, the rocking member 3, joint 7 and piston 8 also move to the respective illustrated positions at the same time, in which the compression ratio is the lowest.

Thus, the compression ratio can be controlled to high and low values hydraulically as desired. The engine speed and the state of the accelerator which controls the rotation of the engine are detected, and the position of the piston is automatically controlled hydraulically according to the degree of load to change the compression ratio of the engine, whereby not only a high output can be obtained in a comfortable state but also the amount of fuel consumed can be decreased.

Further, since the piston rod 46 extends through the cylinder cover 47 and is exposed to the outside, it is easy to detect a compression ratio on the basis of the amount of movement of the piston rod as the piston rod goes in or out with respect to the cylinder cover, whereby an accurate control can be effected.

In addition to the application as an engine, the present invention is also applicable to compressors and vacuum pumps each having an automatic valve such as a ring valve or a flapper valve as the intake-exhaust valve 93 in the cylinder 9. Moreover, since the number of cylinders can be set large, the present invention is also suitable as a large-sized, high-pressure multistage compressor or as a large-sized vacuum pump.

The present invention constructed as above has the following features. Also, the following effects can be obtained because there is adopted a mechanism in which the conventional crank shaft is replaced with the rocking member and there are performed only rocking motions without rotating motions except the output shaft.

(1) Additional mounting of a compression ratio changing mechanism is easy and there can be attained the increase of output and the decrease of the amount of fuel consumed.

(2) Since there are few rotary slide bearing portions, the slip loss is decreased, the mechanical efficiency is improved, and the amount of fuel consumed is decreased.

(3) Since a lateral pressure is little exerted on the piston, there is no frictional loss and the piston is difficult to wear.

(4) The size and weight can be reduced.

(5) Assembly and disassembly are easy.

What is claimed is:

1. A crankless engine comprising a piston which reciprocates in a cylinder and a rocking member capable of changing a rocking fulcrum, said rocking member comprising a pin portion and an outer-periphery connection both formed integrally with each other, said piston and said outer-periphery connection being interconnected through a joint, and a front end of said pin portion being pivotally connected inclinedly through a rotatably-supported rotary shaft, in which the reciprocating motion of said piston and the rotating motion of said rotary shaft are transformed from one to the other.

2. A crankless engine according to claim 1, wherein said cylinder is provided with a cylinder head having a spark plug and an intake-exhaust valve mechanism, and the reciprocating motion of said piston is transformed into the rotating motion of said rotary shaft for operation as an internal combustion engine.

3. A crankless engine according to claim 1, wherein an intake pipe and an exhaust pipe are connected to said cylinder, and the rotating motion of said rotary shaft is transformed into the reciprocating motion of said piston for operation as a pressurizing or pressure-reducing engine.

4. A crankless engine according to claim 1, wherein said rocking member is connected to a bracket which is fixed to a case through a spherical bearing.

5. A crankless engine according to claim 1, wherein said rocking member is connected to a bracket which is fixed to a case through a cross-type bearing.

6. A crankless engine according to claim 5, wherein said joint and said piston, as well as said joint and said outer-periphery connection, are interconnected with pins, respectively.

7. A crankless engine according to claim 1, wherein a weight balancer is disposed at an end portion of said rotary shaft opposedly to the pivoted position of said pin portion.

8. A crankless engine according to claim 1, wherein an output shaft for auxiliary machinery is connected to a portion of said rocking member which portion performs a rotating motion.

9. A crankless engine according to claim 1, wherein said joint comprises a slider and a sliding hole, said slider being slidably connected to said outer-periphery connection through a shaft.

10. A crankless engine according to claim 1, wherein said joint is connected to said outer-periphery connection of said rocking member through a spherical bearing, and said joint and said piston are interconnected through a spherical bearing.

11. A crankless engine according to claim 1, wherein said cylinder which receives said piston therein is disposed on each of both right and left sides of said rocking member in a facing relation to each other.

12. A crankless engine according to claim 1, wherein said cylinder which receives said piston therein is disposed on either the right or the left side of said rocking member.

13. A crankless engine according to claim 10 or 11, wherein plural said cylinders are disposed around said rocking member.

14. A crankless engine according to claim 1, wherein two or more multicylinder crankless engines each having one rotary shaft are disposed side by side, and a gear is mounted on each said rotary shaft, said gears on said rotary shafts being in mesh with each other so that they are shifted in cycle phase.

15. A crankless engine according to claim 1, wherein the front end of said pin portion is pivotally connected to an end portion of said rotary shaft through a spherical bearing.

16. A crankless engine according to claim 1, combined with a mechanism for stabilizing the rocking motion of said rocking member.

17. A crankless engine according to claim 16, wherein said stabilizing mechanism comprises a bevel gear on the back side opposite to the pin portion-disposed side of said rocking member, and a bevel gear meshing with said bevel gear and mounted to a case.

18. A crankless engine according to claim 16, wherein said stabilizing mechanism comprises a cylindrical gear formed projectingly at a front end of said outer-periphery connection of said rocking member, and a gear meshing with said cylindrical gear and mounted to a case.

19. A crankless engine according to claim 16, wherein said stabilizing mechanism comprises a slide pin provided projectingly at a front end of a said outer-periphery connection of said rocking member, and a guide mounted to a case, said guide having a slot for guiding said slide pin.

20. A crankless engine according to claim 16, wherein said stabilizing mechanism comprises a sliding surface formed on a side portion of said outer-periphery connection of said rocking member, and a guide member mounted to a case for guiding said sliding surface while being in abutment with the sliding surface.

21. A crankless engine according to claim 4, combined with a mechanism for changing the compression ratio in said cylinder, said compression ratio changing mechanism comprising a rod projecting into the spherical portion of a spherical bearing and a cylindrical shaft in which is fitted said rod slidably, the end of said rod opposite to the end projecting into said spherical portion being connected to a hydraulic piston which is moved by an oil pressure, and pin portion of said rocking member is slidably connected to said rotary shaft.

* * * * *